US005509829A

United States Patent [19]

Saba

[11] Patent Number: 5,509,829

[45] Date of Patent: Apr. 23, 1996

[54] RETAINER MOUNTING STRUCTURE OF CONNECTOR

[75] Inventor: Toshikazu Saba, Yokkaichi, Japan

[73] Assignee: Sumitomo Wiring Systems, Ltd., Mie, Japan

[21] Appl. No.: 346,232

[22] Filed: Nov. 22, 1994

[30] Foreign Application Priority Data

Nov. 25, 1993 [JP] Japan ..... 5-067942

[51] Int. Cl.[6] ..... H01R 13/436

[52] U.S. Cl. ..... 439/752

[58] Field of Search ..... 439/595, 752

[56] References Cited

U.S. PATENT DOCUMENTS

| | | | |
|---|---|---|---|
| 4,758,182 | 7/1988 | Arbo et al. | 439/752 |
| 4,946,399 | 8/1990 | Kawashima | 439/752 |
| 5,066,252 | 11/1991 | Kato et al. | 439/752 |
| 5,145,419 | 9/1992 | Yamanashi et al. | 439/752 |
| 5,252,095 | 10/1993 | Breitschaft et al. | 439/752 |
| 5,252,096 | 10/1993 | Okada | 439/752 |
| 5,324,208 | 6/1994 | Kodama et al. | 439/271 |

FOREIGN PATENT DOCUMENTS

| | | |
|---|---|---|
| 4010440C1 | 10/1991 | Germany . |
| 4320540A1 | 1/1994 | Germany . |
| 4-322079 | 12/1992 | Japan . |
| 2211033 | 6/1989 | United Kingdom . |

*Primary Examiner*—Gary F. Paumen
*Attorney, Agent, or Firm*—Oliff & Berridge

[57] ABSTRACT

A tubular extension portion is extended from an edge portion of a retainer mounting a hole at an upper surface of a connector housing. A retainer has a flange. When the retainer is fitted in the retainer mounting hole, the flange is abutted against an upper end of the tubular extension portion, so that the retainer mounting hole is closed similar to a lid to prevent water or the like from intruding into the retainer mounting hole from the upper surface of a connector. Water, dropping from above the retainer mounting hole, falls on the upper surface of the retainer and the flange, and flows to the upper surface of the connector housing across an outer peripheral edge of the flange. Therefore, the water will not intrude into a gap between the retainer and the retainer mounting hole. Also, because the water on the upper surface of the connector housing cannot flow up and over the tubular extension portion, water also will not flow into the retainer mounting hole from here.

11 Claims, 5 Drawing Sheets

RETAINER MOUNTING STRUCTURE OF CONNECTOR

BACKGROUND OF THE INVENTION

This invention relates to a retainer mounting structure in which a retainer is fitted in a retainer mounting hole, formed in an upper surface of a connector mounted in a predetermined posture, to retain metal terminals against withdrawal.

FIGS. 6 and 7 show prior means for mounting a retainer for retaining metal terminals against withdrawal in a connector mounted in a predetermined posture, the metal terminals being mounted respectively in cavities in the connector.

A connector 30 has a hood portion 31 for receiving a mating connector (not shown), and has a plurality of cavities 32 therein for receiving the metal terminals (not shown), respectively. A distal end portion of the hood portion 31 is fitted in a connector mounting hole formed in a panel 33, so that the cavities 32 are arranged in rows in a vertical direction. In a condition shown in FIG. 6, a dust prevention cover 34 is releasably attached to the hood portion 31.

The thus mounted connector 30 has two retainer mounting holes 35 and 35 which are open respectively to an upper and a lower surface of the connector, and are in communication with the cavities 32. A retainer 36 is fitted in each of the retainer mounting holes 35 to retain the metal terminals inserted in their proper position in the respective cavities 32. The retainers 36 are retainingly engaged with the metal terminals to hold them against withdrawal.

In the above conventional retainer mounting structure, as better shown in FIG. 7, that surface of each retainer 36 (fitted in the retainer mounting hole 35) exposed to the exterior of the connector 30 lies flush with an edge of the retainer mounting hole 35 disposed at an outer surface 30*a* of the connector 30, and a gap S between an inner surface of the retainer mounting hole 35 and an outer surface of the retainer 36 extends straight from an inner side of the retainer mounting hole 35, and is open to the outer surface 30*a* of the connector 30.

Therefore, at the upper surface of the connector 30, water or the like intrudes into the retainer mounting hole 35 through the gap S between the retainer mounting hole 35 and the retainer 36 fitted therein, and wets the metal terminals in the cavities 32, so that leakage, though slight, may occur.

SUMMARY OF THE INVENTION

The present invention has been made in view of the foregoing, and an object of the invention is to provide a retainer mounting structure in which water or the like is prevented from intruding into a retainer mounting hole from an upper surface of a connector.

The above and other objects are achieved by a retainer mounting structure of a connector according to the present invention, in which a connector is mounted in a predetermined posture and has metal terminals mounted respectively in cavities in the connector. A retainer mounting hole in communication with the cavities is formed in an upper surface of the connector. An open end of the retainer mounting hole is extended in a tubular shape from the upper surface of the connector. A retainer for retaining the metal terminals against withdrawal is fitted in the retainer mounting hole. The retainer has a flange that is abutted against the open end of the tubular extension portion of the retainer mounting hole to close and seal the retainer mounting hole.

In a retainer mounting structure of one embodiment, the thickness of the tubular extension portion on two opposing sides is different, and a bent (angled) portion, engaged with an outer peripheral surface of the tubular extension portion, is formed on a peripheral edge of the flange.

In a retainer mounting structure of a connector according to another embodiment, a recess-like jig engagement portion, with which a retainer removal jig is engageable, is formed in an outer periphery of the retainer between the flange and the tubular extension portion.

In the present invention, when the retainer is fitted in the retainer mounting hole, the flange of the retainer is abutted against the open end of the tubular extension portion of the retainer mounting hole, so that the open end of the retainer mounting hole is closed and sealed similar to that achieved by a lid. In this condition, water or the like, dropping on the upper surface of the retainer from above the retainer mounting hole, flows to the upper surface of the connector through the outer surface of the flange. Since the tubular extension portion, serving as the open end of the retainer mounting hole, is extended upwardly from the upper surface of the connector housing, the water or the like, flowed to the upper surface of the connector, will not flow over the tubular extension portion, and hence will not flow into the retainer mounting hole.

In the invention of the first embodiment, the thickness of the tubular extension portion is different on opposite sides. Therefore, when the retainer is not fitted in a proper direction, the bent portion of the flange engages the end surface of the tubular extension portion, and hence cannot properly engage the outer surface thereof, so that the retainer can be completely fitted in the retainer mounting hole in a proper direction.

In the invention of the second embodiment, for structural reasons, the portion of engagement between the flange and the tubular extension portion is directed in the lateral direction, and even if the engagement portion is formed in this area, water hardly intrudes. This provides for better waterproofness as compared with the conventional construction where the gap S is directed upwardly. Therefore, such a conventional engagement portion defines a recess directed upward, so that water can easily be collected therein.

As described in the above operation, in the present invention, the edge portion of the open end of the retainer mounting hole is extended upwardly in a tubular shape from the upper surface of the connector, and the flange of the retainer is abutted against the open end of the tubular extension portion. Therefore, water or the like is positively prevented from intruding into the retainer mounting hole.

BRIEF DESCRIPTION OF THE DRAWINGS

The invention will now be described in detail with reference to the following drawings, wherein.

DETAILED DESCRIPTION OF PREFERRED EMBODIMENTS

A preferred embodiment of the present invention will now be described with reference to FIGS. 1 to 4.

Figure 1:
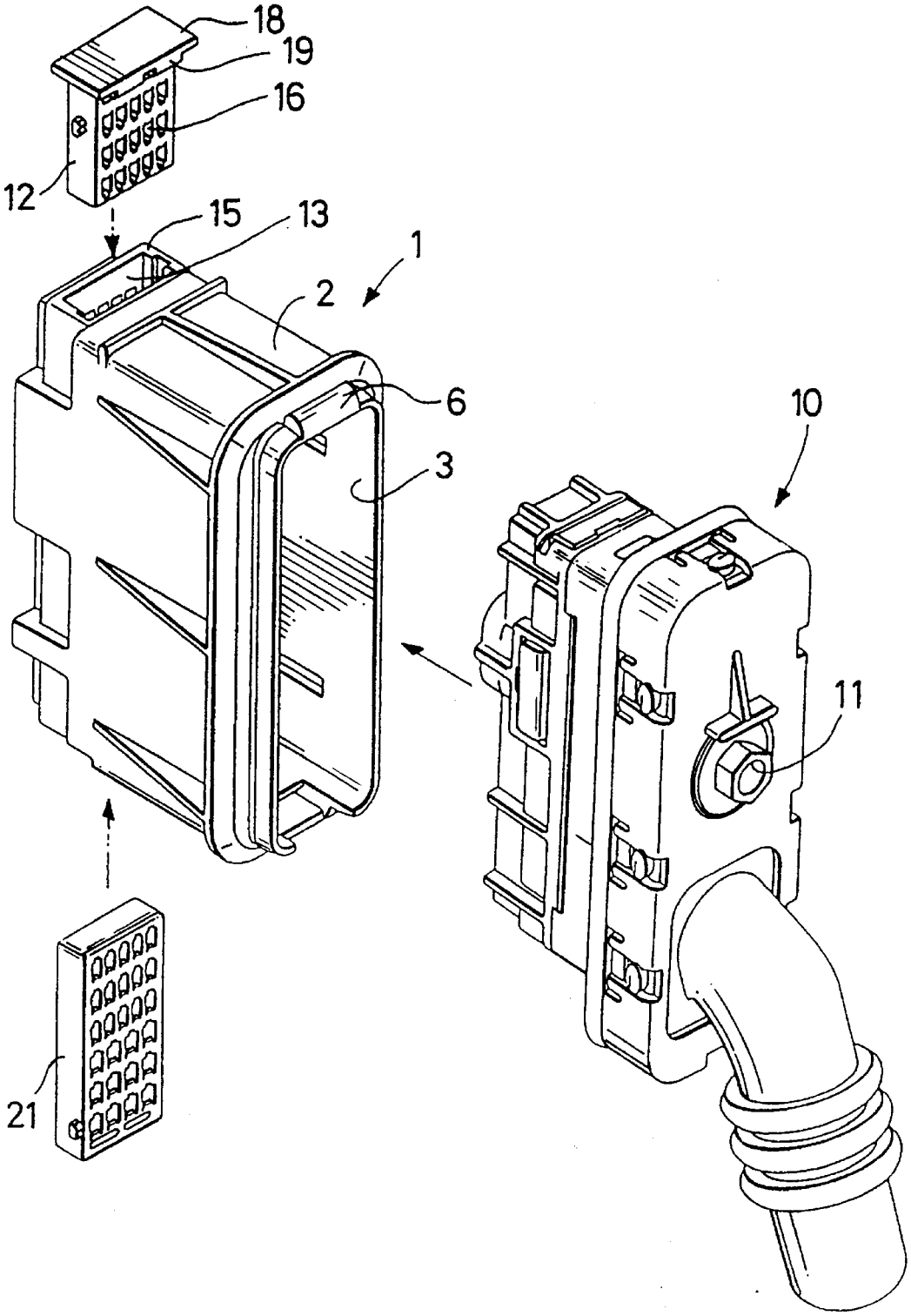
FIG. 1 is an exploded, perspective view showing a first embodiment of a connector of the invention as well as a mating connector.
Figure 2:
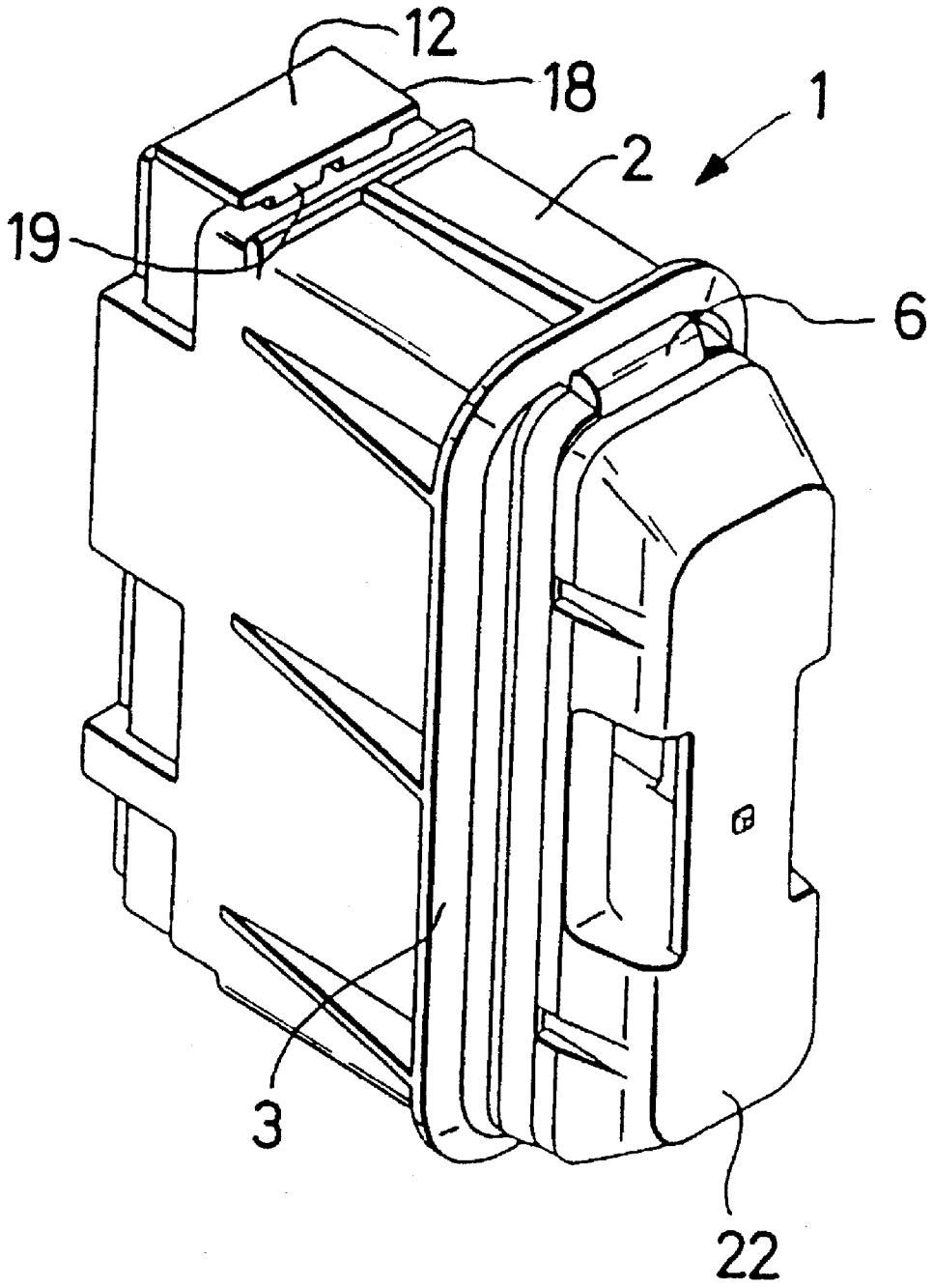
FIG. 2 is a perspective view of the connector of the first embodiment.
Figure 3:
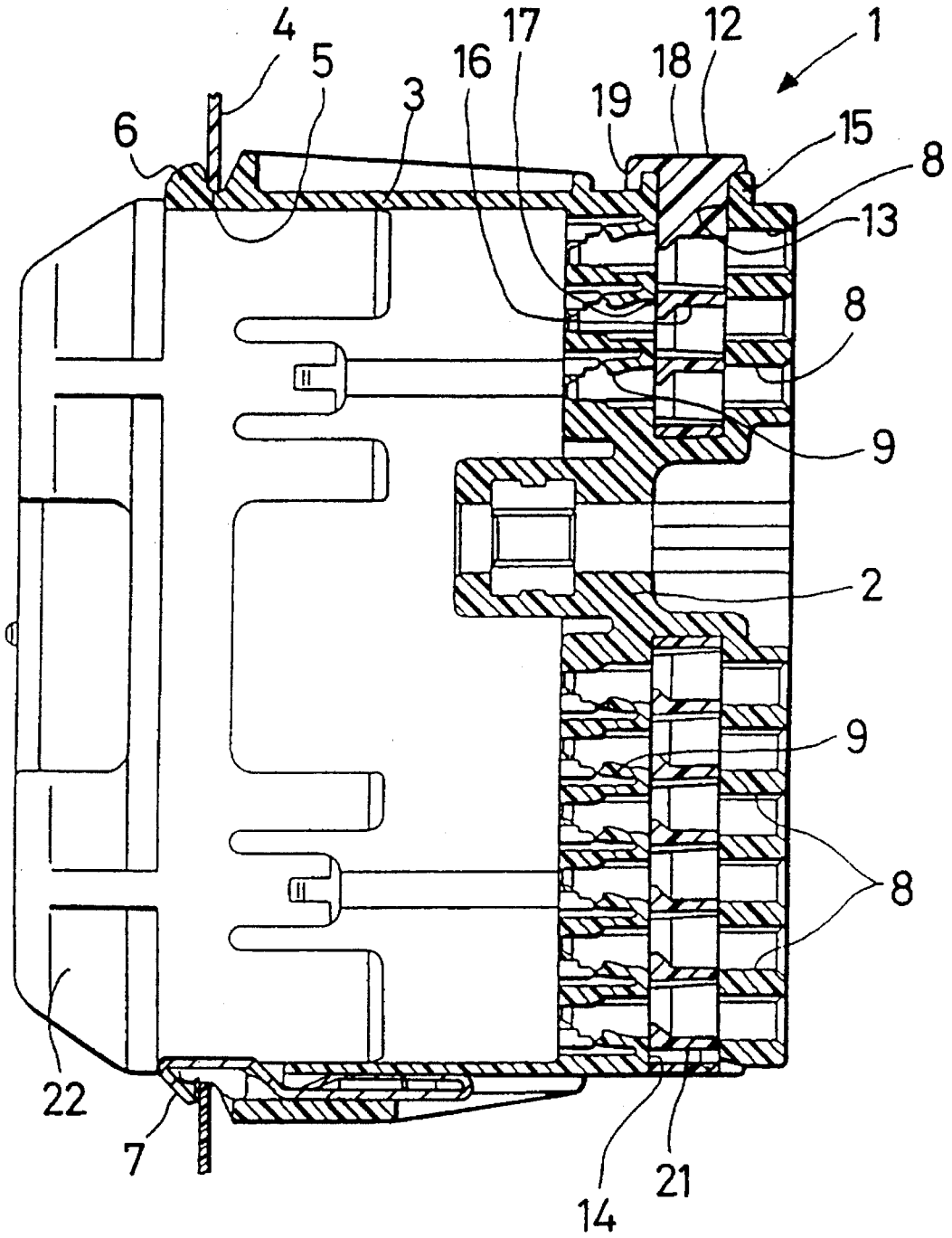
FIG. 3 is a cross-sectional view showing a seal construction of the first embodiment.
Figure 4:
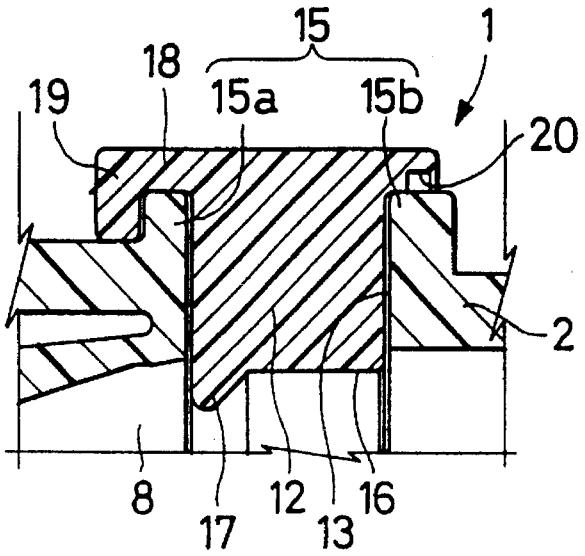
FIG. 4 is an enlarged, cross-sectional view showing the seal construction of the first embodiment.

A connector 1 of this embodiment comprises a connector housing 2 of a rectangular parallelepipedic shape having a hood portion 3 of a rectangular cross-section formed at a front side thereof. A distal end portion of the hood portion 3 is fitted in a mounting hole 5, formed through a vertically-disposed panel 4, from an inner side (right side in FIG. 3) of this panel. An engagement projection 6, formed on an upper side of the hood portion, is engaged with an upper edge of the mounting hole 5 while a locking piece 7, provided on a lower side thereof, is elastically deformed and is engaged with a lower edge of the mounting hole 5. Thus, the connector is fixedly mounted in a predetermined posture. In FIGS. 2 and 3, a hood cover 22 for dust prevention purposes is attached to the hood portion 3.

A plurality of cavities 8 are formed in the connector housing 2 of the connector 1 fixedly mounted on the panel 4, and are arranged in columns and rows. The cavities 8 are open to a rear face (right face in FIG. 3) of the connector housing and also to an inner end face of the hood portion 3. Male metal terminals (not shown) are inserted respectively into the cavities 8 from the rear side, and are retained by respective lances 9 (formed respectively in the cavities 8) against withdrawal from the cavities 8.

A mating connector 10 is fitted in the hood portion 3 of the connector 1, fixedly mounted on the panel 4, from the outer side (left side in FIG. 3) of the panel 4, and is fixedly secured to the connector 1 by a bolt 11. Cavities (not shown) are also formed in the mating connector 10, and female metal terminals (not shown) are inserted respectively into these cavities. These female metal terminals are fitted on and electrically connected to respective male metal terminals of the connector 1 when the two connectors 1 and 10 are fitted together.

Retainers 12 and 21, which cooperate with the lances 9 to provide double-retaining means, are attached to the connector 1 to retain the male metal terminals against withdrawal from the cavities 8. A structure for mounting these retainers will now be described. A retainer mounting hole 13 of a rectangular cross-section is formed in the connector housing 2, and is open to the upper surface of the connector housing 2 fixedly mounted on the panel 4. The hole 13 extends downwardly from this upper surface through the cavities 8. A retainer mounting hole 14 of a rectangular cross-section is also formed in the connector housing 2, and is open to the lower surface of the connector housing. The hole 14 extends upwardly from this lower surface through the cavities 8.

A tubular extension portion 15 of a rectangular cross-section, extending upwardly from the upper surface of the connector housing 2, is formed at an edge portion of the retainer mounting hole 13 (open to the upper surface of the connector housing 2) over an entire periphery thereof. An inner peripheral surface of the tubular extension portion 15 is continuous with the inner peripheral surface of the retainer mounting hole 13. A front wall 15*a* (left wall in FIGS. 3 and 4) of the tubular extension portion 15 is smaller in thickness than a rear wall 15*b* thereof disposed parallel to the front wall 15*a*.

The retainer 12 is fitted in the retainer mounting hole 13. The retainer 12 has a plurality of fitting holes 16 which are open to the front and rear faces thereof, and correspond respectively to the associated cavities 8. Each fitting hole 16 has a retaining portion 17 for engagement with the male metal terminal inserted into the associated cavity 8. Before the male metal terminals are inserted into the respective cavities 8, the retainer 12 is fitted in the retainer mounting hole 13, and is retained in a provisionally-attached position before a completely-attached (final) position. In this condition, the male metal terminals are inserted into the respective cavities 8, and then the retainer 12 is moved from the provisionally-attached position to the completely-attached position. As a result, the retaining portions 17 of the retainer 12 engage the respective male metal terminals to retain them against withdrawal.

The retainer 12, adapted to be fitted in the retainer mounting hole 13 open to the upper surface of the connector housing 2, has a flange 18 formed on the upper end thereof extending over the entire periphery. When the retainer 12 is completely fitted into the completely-attached position in the retainer mounting hole 13, the flange 18 abuts against the upper end surface of the tubular extension portion 15.

A bent portion 19 extends downwardly from an edge portion of a front side of the flange 18. The bent portion 19 can face the front wall 15*a* (smaller in thickness than the rear wall 15*b*) of the tubular extension portion 15, and can abut against the outer surface of this front wall 15*a*.

The edge portion of the outer side of the flange 18 is notched at its lower surface to provide a jig engagement portion 20. A retainer removal jig (not shown) for withdrawing the retainer 12 from the retainer mounting hole 13 can be engaged with this jig engagement portion 20.

A tubular extension portion as formed at the upper retainer mounting hole 13 is not provided at the retainer mounting hole 14 open to the lower surface of the connector housing 2, and a flange as formed at the upper retainer 12 is not formed on the retainer 21 to be fitted in the retainer mounting hole 14. Therefore, when the retainer 21 is fitted in-the retainer mounting hole 14, the lower surface of the retainer 21 lies flush with the lower surface of the connector housing 2, and a gap between the retainer mounting hole 14 and the retainer 21 is open to the lower surface of the connector housing 2.

The operation of this embodiment will now be described. When the retainer 12 is fitted in the upper retainer mounting hole 13 of the connector housing 2, the flange 18 of the retainer 12 abuts against the upper end surface of the tubular extension portion 15 over the entire periphery thereof, so that the open end of the retainer mounting hole 13 is closed and sealed similar to that achieved by a lid. In this condition, the gap between the retainer mounting hole 13 and the retainer 12 is open laterally or downwardly between the upper end surface of the tubular extension portion 15 and the lower surface of the flange 18.

Therefore, water or the like, dropping right above the retainer mounting hole 13, falls on the upper surface of the retainer 12 and the flange 18, and flows to the upper surface of the connector housing 2 directly across the outer peripheral surface of the flange or down the outer peripheral surface of the tubular extension portion 15. Therefore, the water will not intrude into a gap between the retainer 12 and the retainer mounting hole 13.

The tubular extension portion 15, serving as the open end of the retainer mounting hole 13, extends upwardly from the upper surface of the connector housing. Therefore, there is no fear that the water or the like on the upper surface of the connector housing 2 will flow over the tubular extension portion 15, and intrude into the gap between the retainer 12 and the retainer mounting hole 13.

As described above, in the retainer mounting structure of this embodiment, water or the like is positively prevented from intruding into the retainer mounting hole 13 open to the upper surface of the connector housing 2.

When the retainer 12 is to be fitted in the retainer mounting hole 13 in such a manner that the front-rear direction of the retainer 12 is reversed, the bent portion 19 of the flange 18 abuts against the upper end surface of the rear wall 15*b* (thicker than the front wall 15*a*) of the tubular extension portion 15 before the retainer 12 reaches the completely-attached position, so that the retainer 12 is prevented from further fitting. If the direction of the retainer 12 is thus reversed, the retainer 12 cannot be completely fitted, and therefore failure to retain the male metal terminals against withdrawal, due to the reverse fitting of the retainer 12, can be prevented.

Once fitted in the retainer mounting hole 13, the retainer 12 can be removed by engaging the retainer removal jig (not shown) in the jig engagement portion 20 of the flange 18. The retainer 12 can be removed more easily using the jig than removal by hand. This recess (20) is open in a horizontal direction, and therefore the intrusion of water hardly occurs. Such a jig engagement portion may be provided at the upper end of the tubular extension portion 15.

Figure 5:
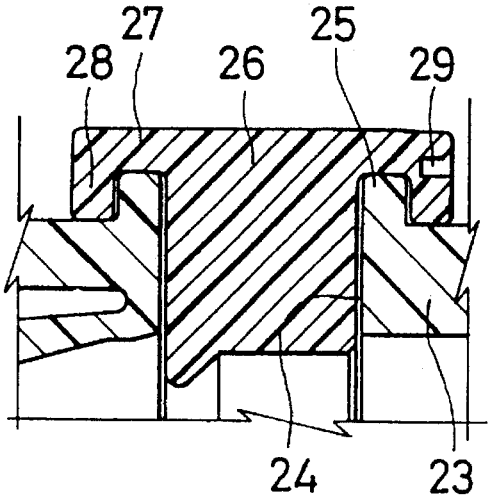
FIG. 5 is a cross-sectional view showing a seal construction of a second embodiment.
Figure 7:
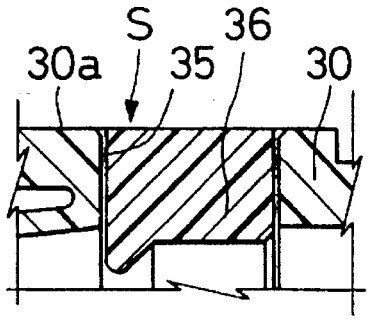
FIG. 7 PRIOR ART
FIG. 7 is an enlarged, cross-sectional view of the seal construction of the conventional example.
Figure 6:
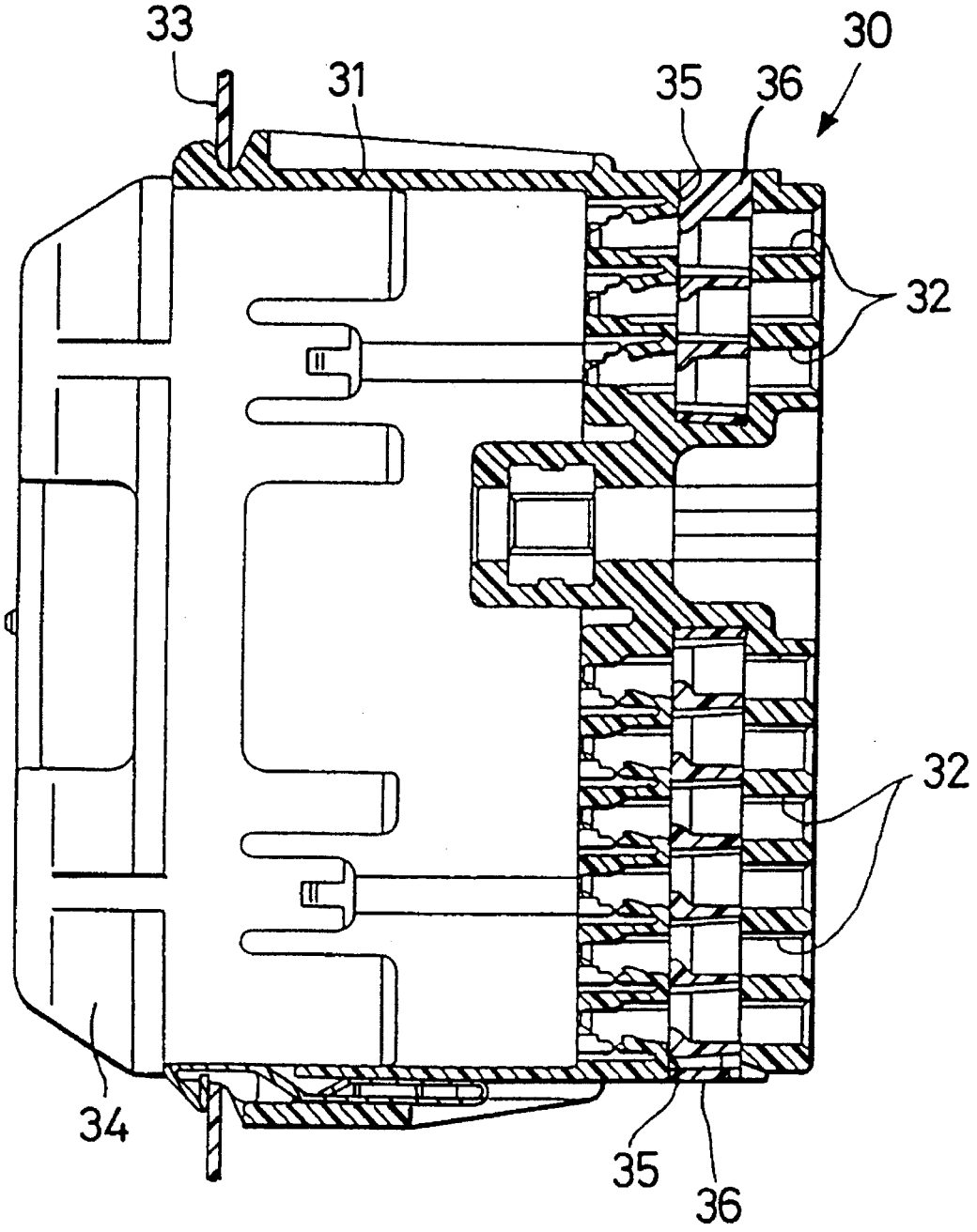
FIG. 6 PRIOR ART
FIG. 6 is a cross-sectional view showing a seal construction of a conventional example.

A second embodiment of the present invention will now be described with reference to FIG. 5.

A tubular extension portion 25 of a rectangular cross-section, extending upwardly from an upper surface of a connector housing 23, is formed at an edge portion of a retainer mounting hole 24 (open to an upper surface of the connector housing 23) over an entire periphery thereof. A retainer 26 for fitting in the retainer mounting hole 24 has a flange 27 formed on an upper end thereof over an entire periphery thereof. A downwardly-directed, tubular fitting portion 28 is formed on an outer edge of the flange 27. The tubular fitting portion 28 is fitted on the tubular extension portion 25, and is in contact with an outer surface of portion 25. A jig engagement portion 29, with which a retainer removal jig (not shown) is engageable, is formed in an outer peripheral surface of the flange 27.

The operation of this embodiment will now be described. When the retainer 26 is fitted in the retainer mounting hole 24, the flange 27 of the retainer 26 abuts against the upper end surface of the tubular extension portion 25 over the entire periphery thereof, and the tubular fitting portion 28 fits around the tubular extension portion 25, and abuts at its distal end against the upper surface of the connector housing 23. In this condition, the open end of the retainer mounting hole 24 is closed and sealed similar to that achieved by a lid. A gap between the retainer mounting hole 24 and the retainer 26 extends in a curved manner along the upper end surface and outer peripheral surface of the tubular extension portion 25, and is laterally open between the distal end surface of the tubular fitting portion 28 and the upper surface of the connector housing 23.

Therefore, water or the like, dropping right above the retainer mounting hole 24, falls on the upper surface of the retainer 26 and the flange 27, and flows to the upper surface of the connector housing 23 across the outer peripheral edge of the flange and the outer peripheral surface of the tubular fitting portion 28. Therefore, the water will not intrude into the gap between the retainer 26 and the retainer mounting hole 24. Moreover, the water on the upper surface of the connector housing 23 will not intrude into the retainer mounting hole 24 through the curved gap between the retainer mounting hole 24 and the retainer 26.

Once fitted in the retainer mounting hole 24, the retainer 26 can be easily removed by engaging the retainer removal jig (not shown) in the jig engagement portion 29 of the flange 27.

The present invention is not limited to the above embodiments, and as examples, the following modifications can be made. In the above embodiments, although the connector is mounted on the panel, so that the connector is fixed and kept in the predetermined posture, the connector of the present invention can be fixed to a member other than the panel.

Furthermore, the present invention is not limited to the embodiments described above and shown in the drawings, and various modifications can be made without departing from the scope of the invention.

What is claimed is:

1. A retainer mounting structure of a connector comprising:

a connector having metal terminals inserted respectively in cavities in said connector in a longitudinal direction, a retainer mounting hole in communication with said cavities extending inwardly from an outer surface of said connector in a direction normal to said longitudinal direction, an open end of said retainer mounting hole extending from the outer surface of said connector to form an extension portion, and a retainer for retaining said metal terminals against withdrawal is fitted in said retainer mounting hole, said retainer having a flange that is abutted against the open end of the extension portion of said retainer mounting hole to close and seal said retainer mounting hole.

2. A retainer mounting structure of a connector according to claim 1, in which a thickness of two opposing sides of said extension portion is different, and an angled portion is formed on a peripheral edge of said flange and engages with an outer peripheral side surface of said extension portion.

3. A retainer mounting structure of a connector according to claim 1, in which a jig engagement portion sized to engage with a retainer removal jig is formed in an outer periphery of said retainer between said flange and said extension portion.

4. A connector and retainer mounting structure comprising:

a connector mounted in a predetermined position to define an upper surface of said connector;

at least one cavity formed in said connector for receiving a terminal in a longitudinal direction;

a retainer mounting hole formed in the upper surface of said connector and extending inwardly from the upper surface in a direction normal to said longitudinal direction to communicate with said at least one cavity, said retainer mounting hole including an extension portion extending outwardly above said upper surface and defining extending peripheral sides having peripheral side surfaces, vertical inner walls, and an open end;

a retainer for retaining said terminal against withdrawal, said retainer being fitted in said retainer mounting hole, said retainer including a flange that closes and seals the vertical inner walls of said retainer mounting hole by abutting against the open end of said extension portion.

5. The connector and retainer mounting structure of claim 4, wherein said flange includes an angled portion that extends inward toward said connector and engages at least one of said extending peripheral sides.

6. The connector and retainer mounting structure of claim 5, wherein thicknesses of two opposing extending sides of said extension portion are different, one of said two opposing sides being too thick to allow engagement of said angled portion with said corresponding peripheral side surface such that said retainer can only be fitted in one proper orientation.

7. The connector and retainer mounting structure of claim 4, wherein said flange includes a fitting portion extending inwardly toward said connector around an entire periphery of said flange for engaging said peripheral side surfaces of said extension portion.

8. A connector and retainer mounting structure comprising:

a connector mounted in a predetermined to define an upper surface of said connector;

at least one cavity formed in said connector for receiving a terminal in a longitudinal direction;

a retainer mounting hole formed in the upper surface of said connector and extending inwardly from the upper surface in a direction normal to the longitudinal direction to communicate with said at least one cavity, said retainer mounting hole including an extension portion extending outwardly above said upper surface and defining extending peripheral sides having peripheral side surfaces, vertical inner walls, and an open end;

a retainer for retaining said terminal against withdrawal, said retainer being fitted in said retainer mounting hole and defining a vertical gap between said vertical inner walls of said extension portion and said retainer, said retainer including a flange having peripheral dimensions that close and seal the vertical gap and abut said open end of said tubular extension portion and form a horizontal gap.

9. The connector and retainer structure of claim 8, further comprising a portion extending toward said connector from said horizontal gap.

10. The connector and retainer structure of claim 9, wherein said portion extends completely around said flange to form an inwardly extending fitting portion that engages said peripheral side surfaces of said extension portion.

11. The connector and retainer structure of claim 8, further comprising a jig engagement portion formed in said retainer.

* * * * *